US008336670B2

(12) United States Patent
Viehmann et al.

(10) Patent No.: US 8,336,670 B2
(45) Date of Patent: Dec. 25, 2012

(54) MICROELECTROMECHANICAL SYSTEM TESTING DEVICE

(75) Inventors: Michael Viehmann, Schechen/Pfaffenhofen (DE); Werner Schütz, Rohrdorf (DE); Alexander Waldauf, Söll (AT)

(73) Assignee: Rasco GmbH, Kolbermoor (DE)

( * ) Notice: Subject to any disclaimer, the term of this patent is extended or adjusted under 35 U.S.C. 154(b) by 0 days.

(21) Appl. No.: 13/032,065

(22) Filed: Feb. 22, 2011

(65) Prior Publication Data

US 2011/0226544 A1 Sep. 22, 2011

(30) Foreign Application Priority Data

Mar. 16, 2010 (EP) ..... 10002764

(51) Int. Cl.
*H04R 29/00* (2006.01)

(52) U.S. Cl. ..... 181/198; 381/60

(58) Field of Classification Search ..... 181/198; 381/60

See application file for complete search history.

(56) References Cited

U.S. PATENT DOCUMENTS 3,876,035 A 4/1975 Eckel
4,065,647 A * 12/1977 Frye et al. ..... 381/60
4,357,499 A * 11/1982 Bruel ..... 73/571
7,610,810 B2 * 11/2009 Winker ..... 73/571
2007/0269051 A1 * 11/2007 Weidner ..... 381/60

FOREIGN PATENT DOCUMENTS

WO 2010026724 A1 3/2010

OTHER PUBLICATIONS

Fincham, Production Testing of Loudspeakers Using Digital Techniques, Journal of the Audio Engineering Society, Dec. 1, 1979, pp. 970-974, vol. 27, No. 12, New York, USA.

Brüel & Kjaer, Anechoic Test Box—Type 4232, Product Data Brüel & Kjaer, May 1, 1996, pp. 1-4.

* cited by examiner

*Primary Examiner* — Jeremy Luks
(74) *Attorney, Agent, or Firm* — IP Strategies

(57) ABSTRACT

The invention provides a microelectromechanical system testing device, comprising an acoustic chamber having two opposing walls; a sound source for generating sound within the acoustic chamber at a first frequency in the range of 20 Hz to 10 kHz, the sound source being arranged at one of the opposing walls; and an interface for coupling one or more microelectromechanical systems thereto, the interface being arranged at the other of the two opposing walls and comprising a respective coupling site for each microelectromechanical system; wherein the acoustic chamber is adapted to have a total harmonic distortion (THD) at each coupling site of the interface for the first frequency below 1%, preferably below 0.8%, more preferably below 0.6%, most preferably below 0.4% when including all harmonics of the first frequency in the range of 20 Hz to 20 kHz, in particular for the first frequency being 1 kHz or 4 kHz.

20 Claims, 3 Drawing Sheets

MICROELECTROMECHANICAL SYSTEM TESTING DEVICE

FIELD OF THE INVENTION

The present invention relates to a microelectromechanical system testing device and to a microelectromechanical system testing apparatus comprising a microelectromechanical system testing device according to the invention.

BACKGROUND OF THE INVENTION

The Micro-Electro-Mechanical Systems (MEMS) technology is directed to the integration of mechanical elements, sensors, actuators, and electronics on a common silicon substrate using microfabrication technology. While the electronics is fabricated using integrated circuit process sequences, the micromechanical components are fabricated using processes that selectively etch away parts of the silicon wafer or add new structural layers to form the mechanical and electromechanical devices.

MEMS combine silicon-based microelectronics with micromachining technology, making it possible to realize complete systems-on-a-chip. MEMS is a technology allowing the development of smart products, and to add perception and control capabilities of microsensors and microactuators to the computational ability of microelectronics.

A particular type of MEMS is a microelectromechanical system microphone, which is also called a microphone chip or silicon microphone. The pressure-sensitive diaphragm of such a MEMS micophone is etched directly into a silicon chip by MEMS techniques. MEMS microphones are usually variants of the condenser microphone design. In many cases MEMS microphones have built in analog-to-digital converter circuits on the same chip making the chip a digital microphone, which can be integrated with modern digital products such as mobile phones.

MEMS that convert sound into electrical signals, in particular MEMS microphones need to be tested for their correct function. According to the prior art as described e.g. in DE 10 2008 015 916 A, this is done by irradiating sound at the MEMS, with terminals of the MEMS being connected to test electronics. The sound is produced using piezo elements to generate desired frequencies in a sound space. The sound space is chosen such that its largest free length, for example its diagonal extension, is smaller than half of the wavelength of the sound waves generated with the highest frequency. As an example, in case of sound tests with frequencies up to 20 kHz, 10 kHz, and 8 kHz, the disclosure of this prior art document requires a maximum of the free length to be 0.86 cm, 1.7 cm and 2.1 cm, respectively, i.e., the MEMS are tested in the near field region. The sound space needs to be isolated to the outside using O-rings such that standing waves can be generated.

However, this method and this device of the prior art have the disadvantage that the placement of the MEMS is time consuming and difficult to handle.

BRIEF SUMMARY OF THE INVENTION

The problem underlying the present invention in view of the prior art is to provide a microelectromechanical system testing device that has an improved sound quality of test signals and/or that allows a larger MEMS test rate.

The above-mentioned problem is solved by the microelectromechanical system testing device according to claim 1. The microelectromechanical system testing device according to claim 1 comprises an acoustic chamber having two opposing walls;

a sound source for generating sound within the acoustic chamber at a first frequency in the range of 20 Hz to 10 kHz, the sound source being arranged at one of the opposing walls; and an interface for coupling one or more microelectromechanical systems thereto, the interface being arranged at the other of the two opposing walls and comprising a respective coupling site for each microelectromechanical system;

wherein the acoustic chamber is adapted to have a total harmonic distortion (THD) at each coupling site of the interface for the first frequency below 1%, preferably below 0.8%, more preferably below 0.6%, most preferably below 0.4% when including all harmonics of the first frequency in the range of 20 Hz to 20 kHz, in particular for the first frequency being 100 Hz, 1 kHz, 4 kHz or 10 kHz.

The total harmonic distortion (THD) is determined according to the IEC method and is related to the ratio of the power $P_h$ in harmonics of a fundamental frequency to the total power $P_{tot}$ in the fundamental frequency and the harmonics. The total harmonic distortion expressed as a percentage value is calculated from the square root of the power ratio as THD $[\%]=\sqrt{P_h/P_{tot}}\cdot 100$. Equivalently, this can be written as $THD=\sqrt{U_2^2+U_3^2+\ldots+U_n^2}/\sqrt{U_1^2+U_2^2+U_3^2+\ldots+U_n^2}$, wherein the $U_i$ is the RMS voltage that generates the respective power of the i-th harmonic if i=2, 3, . . . , n and of the fundamental frequency when i=1. Since the acoustic chamber is adapted to have a THD value below 1%, for a first frequency that is generated by the sound source, a good sound quality for testing the MEMS at the first frequency is provided.

Moreover, since the microelectromechanical system testing device comprises an interface for coupling one or more microelectromechanical systems thereto and is arranged at the other of the two opposing walls, the MEMS can easily be exposed to the sound generated by the sound source. The interface is configured such that one or more than one MEMS can receive the sound from the inside of the acoustic chamber while being coupled to the interface. The placement of the MEMS to the interface can be performed from the outside of the acoustic chamber.

As an example, when the first frequency is 10 kHz, the fundamental frequency (10 kHz) and the first harmonic thereof at 20 kHz is measured for determining the THD value at 10 kHz. A suitable sound pressure for performing the THD measurement is 94 dB at the fundamental (first) frequency. The sound source is preferentially a point source over the entire frequency range of interest. A preferred embodiment of such a point source is a coaxial driver.

According to a development of the inventive microelectromechanical system testing device the acoustic chamber may be adapted to have a total harmonic distortion (THD) at each coupling site of the interface for the first frequency and simultaneously also for a second frequency below 1%, preferably below 0.8%, more preferably below 0.6%, most preferably below 0.4%, in particular for the first frequency being 1 kHz and the second frequency being 4 kHz. This development provides a good sound quality for two different frequencies at the same time. This increases the flexibility and scope of the tests.

According to a further development the acoustic chamber may be adapted to have a total harmonic distortion (THD) at each coupling site of the interface for any first frequency in the range of 20 Hz to 10 kHz, below 1%, preferably below 0.8%, more preferably below 0.6%, most preferably below 0.4%. This further increases the sound quality over the whole frequency range of sound generated by the sound source.

According to another development the distance between the sound source and the interface may be larger than two times, preferably three times, more preferably four times the largest dimension of the sound source, in particular larger than two times, preferably three time, more preferably four times the diameter of a sound generating membrane of a loudspeaker as the sound source. This development provides that the MEMS are located in the far field of the sound source, which improves the homogeneity of the sound at the interface.

According to a further development a plurality of microelectromechanical systems may be coupleable to the coupling sites of the interface and the microelectromechanical system testing device may be adapted to have a difference in sound pressure at any one of the interface coupling sites and at a reference point at the interface, in particular the center of the interface, of less than 0.2 dB, preferably less than 0.1 dB, and/or the microelectromechanical system testing device may be adapted to have a difference between the total harmonic distortion at any one of the interface coupling sites and at a reference point at the interface, in particular the center of the interface, below 5%, preferably below 2%, more preferably below 1% of the total harmonic distortion at the reference point. This of course refers to the same frequency, i.e., for the first frequency, the first and the second frequency, and all frequencies in the range of 20 Hz to 10 kHz. This homogeneity among the different coupling sites allows to perform more than one MEMS test at the same time and with similar sound quality. A suitable sound pressure to perform the measurements is for example 94 dB.

According to another development the acoustic chamber may be a rectangular box, wherein the distance H between the sound source and the interface is in the range of H=48 cm±12 cm, preferably H=48 cm±8 cm, more preferably H=48 cm±4 cm. This provides for a range of distances between the sound source and the MEMS via the interface that results in good sound quality for a rectangular box. The distance H between the sound source and the interface is measured from the mounting plane of the chassis of the sound source (driver) to the interface.

According to a further development of the last development the length L of the box may be in the range of L=69 cm±21 cm, preferably L=69 cm±14 cm, more preferably L=69 cm±7 cm and/or the width W of the box may be in the range of W=58 cm±21 cm, preferably W=58 cm±14 cm, more preferably W=58 cm±7 cm. These dimensions (perpendicular to the height dimension) further improve the sound quality of the microelectromechanical system testing device in case of a rectangular box as the acoustic chamber.

According to another development inside walls of the acoustic chamber except the wall having the interface may be covered with sound absorbing material. This further improves, i.e. lowers, the THD values.

According to a further development the thickness of the sound absorbing material may be in the range of 5 cm to 15 cm. Such a range of thickness provides for sufficient absorption of undesired harmonics.

According to another development the sound absorbing material may be porous melamine. This absorption material has the advantage of combining the desired acoustic properties with being light-weighted.

According to a further development the surface of the sound absorbing material has a pyramidal structure. This feature reduces reflections of sound waves from the walls in the direction of the interface.

According to another development a ring of sound absorbing material may be arranged around the sound source and may protrude from the sound source in the direction of the interface. This has the advantage of directing the sound from the sound source to the interface.

According to a further development the ring may protrude from the sound source by a distance in the range of 1 cm to 20 cm, preferably in the range of 1 cm to 10 cm, more preferably in the range of 1 cm to 5 cm. Such a protrusion dimensions of the ring has been found to be advantageous for the quality of the sound at the interface.

According to another development the thickness of the ring may be in the range of 1 cm to 5 cm. These dimensions of the ring have been found to be advantageous for the quality of the sound at the interface.

The invention also provides a microelectromechanical system testing apparatus comprising a microelectromechanical system testing device according to the invention or any one of the developments; and a feeding device for feeding microelectromechanical systems to the or each coupling site of the interface; wherein the feeding device is preferably a gravitational, a pick-and-place or a test-in-strip feeding device. According to this development know handles of MEMS can be used. In case of a gravity feed handler, the microelectromechanical system testing device according to the invention is arranged such that the wall including the interface is vertical so that MEMS can be fed gravitationally to the coupling sites. In case of a pick-and-place handler the microelectromechanical system testing device according to the invention is preferably arranged such that the wall including the interface is the top wall and the pick-and-place handler positions the MEMS at the coupling sites of the interface. When using a test-in-strip handler the wall including the interface is the bottom wall and the MEMS devices are positioned at the coupling sites from below.

Further features and advantages of the present invention will be described in the following with reference to the figures, which illustrate only examples of embodiments of the present invention. The illustrated and described features may be suitably combined with each other, in particular with the features of the inventive microelectromechanical system testing device and its developments.

DETAILED DESCRIPTION OF THE INVENTION

As the microelectromechanical system testing devices according to the invention can be used in different orientations (depending for example on the chosen feeding device, relative terms like "bottom" or "top" have only relevance with respect to the described figures, but the actual physical orientation during use may be different from the orientation shown in the figures.

Figure 1:
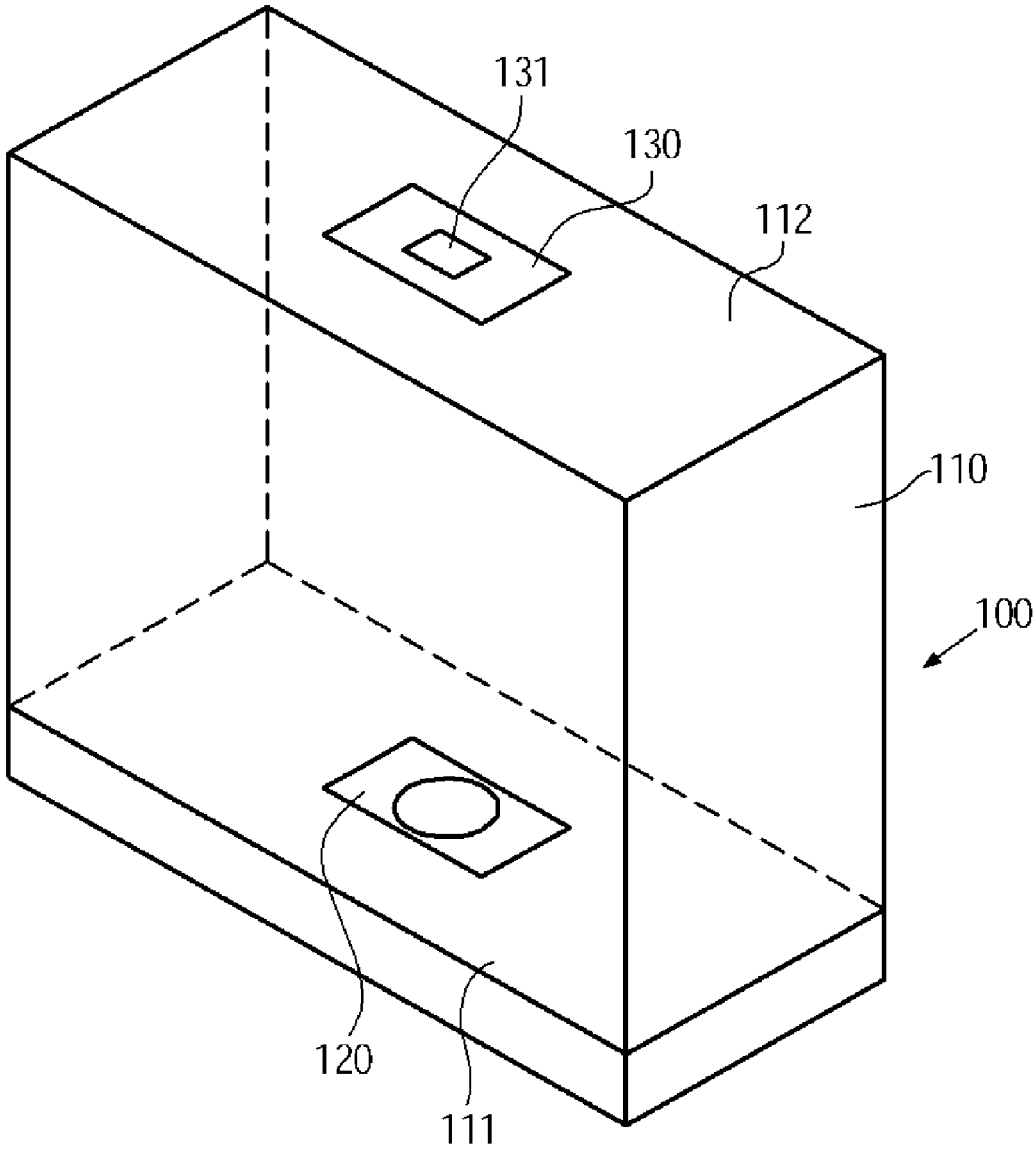
FIG. 1 illustrates a first embodiment of the invention.

FIG. 1 shows a first embodiment of the inventive microelectromechanical system testing device 100.

In this embodiment the microelectromechanical system testing device 100 comprises an acoustic chamber 110 in the form of a rectangular box having two opposing walls 111, 112 and a loud speaker 120 for generating sound within the acoustic chamber 110 at a first frequency in the range of 20 Hz to 10 kHz. In this case the frequency generated by the loud speaker 120 is 100 Hz, 1 kHz, 4 kHz and/or 10 kHz. The sound source 120 is arranged at one of the opposing walls, namely the bottom wall 111. Furthermore, the microelectromechanical system testing device 100 comprises an interface 130 for coupling a microelectromechanical system (MEMS) microphone thereto. The interface 130 is arranged at the other of the two opposing walls, namely the top wall 112 and comprises a respective coupling site 131 for the MEMS microphone that shall be tested.

The MEMS microphone (connected to test electronics) can be placed on the coupling site 231 to be exposed to the sound generated by the loud speaker 120 that propagates within the acoustic chamber 110 to the interface 130 with the coupling site 131. The acoustic chamber 110 is adapted to have a total harmonic distortion (THD) at the coupling site 131 of the interface 130 at 1 kHz or 4 kHz below 1% when including all harmonics of 1 kHz or 4 kHz in the range of 40 Hz to 20 kHz, i.e., for 1 kHz the harmonics 2 kHz, 3 kHz, 4 kHz, . . . , 19 kHz, 20 kHz; and for 4 kHz the harmonics 8 kHz, 12 kHz, 16 kHz and 20 kHz.

Here and in the following embodiments, the measuring process for determining the THD values involves the following steps. A reference microphone may be place at the interface, for example in a central opening thereof and a sinusoidal signal may be applied to the speaker with the frequency of the sinusoidal signal sweeping from 20 Hz to 20 kHz. The sound pressure may for example be 94 dB at 1 kHz. However, due to the propagation of the generated sound waves in the acoustic chamber, the sound pressure will vary over the swept frequency range. The sound pressure is then calibrated at 94 dB for every frequency between 20 Hz and 20 kHz. This can be achieved by correcting the amplitude of the sinusoidal signals feed into the speaker accordingly. Thereafter, the total harmonic distortion (THD) is determined according to the IEC method which is related to the ratio of the power $P_h$ in the harmonics of a fundamental frequency to the total power $P_{tot}$ in the fundamental frequency as well as in the harmonics. The total harmonic distortion expressed as a percentage value is calculated by using the square root of the power ratio, namely $THD[\%]=\sqrt{P_h/P_{tot}}\cdot 100$. Equivalently, the total harmonic distortion can be also written as a fractional value using $THD=\sqrt{U_2^2+U_3^2+\ldots+U_n^2}/\sqrt{U_1^2+U_2^2+U_3^2+\ldots+U_n^2}$, wherein the $U_i$ is the RMS voltage of the i-th harmonic if and the RMS voltage of the fundamental frequency when i=1, an wherein the particular RMS voltage generates the respective to power.

Suitable loud speakers for use in this embodiment and for use in the other embodiments discussed below are point sources over the entire frequency range of interest. For example coaxial drivers, such as the model DC8i from Tannoy® can be used. The acoustic chamber in this embodiment and in the other embodiments discussed below may comprise medium density fiberboards (MDF), in particular as a double layer with sound absorbing material such as bitumen foil in between. This bitumen foil may absorb sound from outside of the acoustic chamber. Suitable bitumen foil may be obtained for example from OTO Akustiktechnik GmbH having a thickness of 2.6 mm, 4.3 mm or 5.5 mm.

Figure 2:
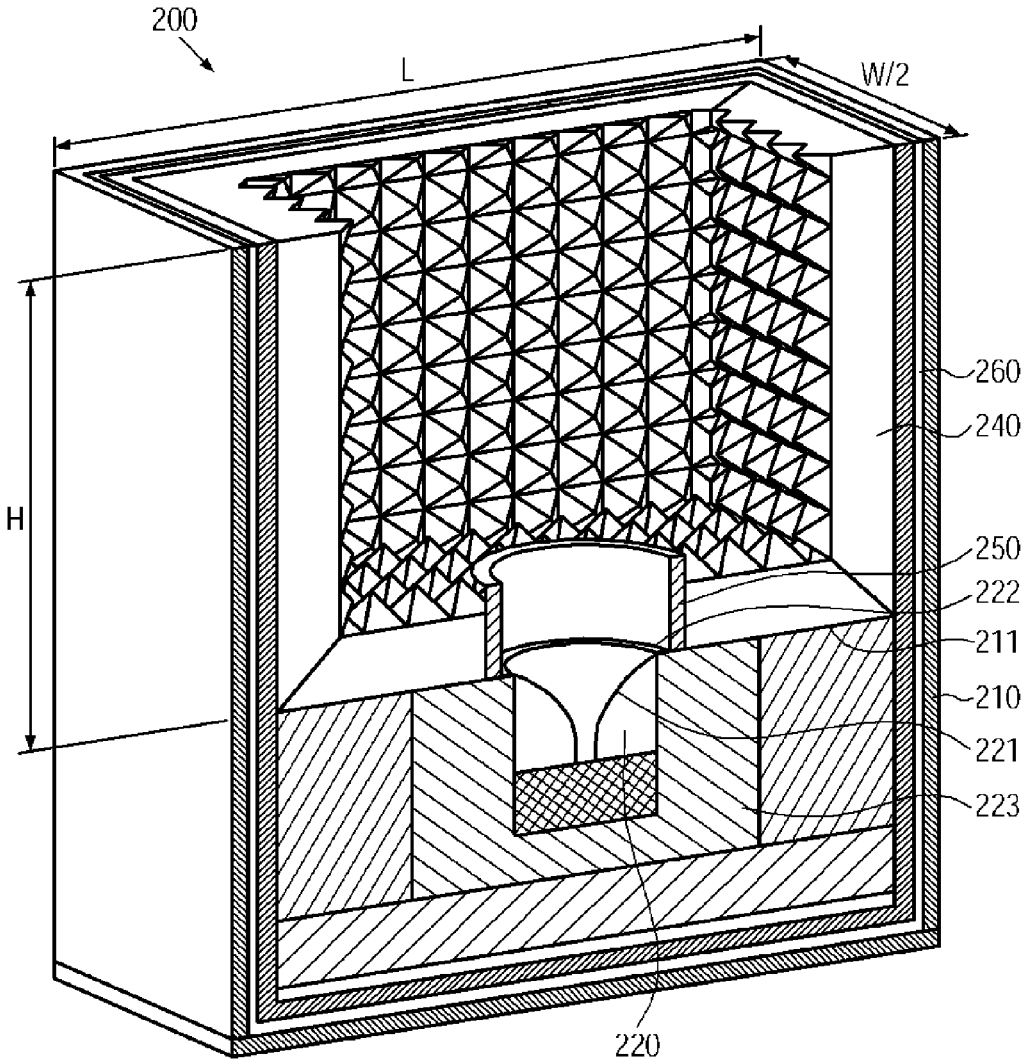
FIG. 2 illustrates a second embodiment of the invention.

FIG. 2 shows a second embodiment of the inventive microelectromechanical system testing device 200, wherein features corresponding to features in the first embodiment have the same reference sign in the last two digits and differ only in the hundreds that is increased from 1 to 2.

In this second embodiment the microelectromechanical system testing device 200 comprises an acoustic chamber 210 in the form of a rectangular box, similar to the first embodiment. The upper wall is omitted in this drawing for illustrative purposes. The upper wall of this embodiment comprises an interface with rectangular dimensions of 60 mm×180 mm and having eight coupling sites for coupling eight MEMS microphones thereto at the same time which can then be tested simultaneously. However, any other number of coupling sites such as 4, 5, 6, 7, 9 or 10, for example, may be provided. Moreover, the interface of the second embodiment has an opening for placing a reference microphone into the opening such that sound pressure can be measured, particularly at different frequencies.

Furthermore, in this figure the acoustic chamber is cut in the vertical direction, such that only one half in the width direction/dimension W is shown. The acoustic chamber 210 of this embodiment has the following inside dimensions: height H from wall 211 to the interface of 48 cm (with a total height from the lower MDF plate to the upper plate having the interface of 87 cm), a length L of 49 cm and a width W of 38 cm. The wall 211 defining the surface including the outer edge of the loud speaker may be a solid plate such as an MDF plate with an opening for the speaker or it may be the surface of absorbing material used to fill the space around the speaker. The loud speaker comprises a box 223 and a sound source/driver 220 having a membrane 221 and a chassis 222 to which the membrane 221 is connected. The chassis 222 is mounted on the wall 211 defining the mounting plane of the sound source. The distance H between the sound source 220 and the interface is measured from the mounting plane 211 of the chassis 222 (also called supporting basket or frame) of the sound source (driver) to the interface.

Moreover, the inside of the acoustic chamber is covered with sound absorbing material 240 with pyramidal structure. A suitable sound absorbing material can be obtained as pyramidal open-cell, fiber-free melamine foam from pinta acoustic gmbh having a degree of sound absorption of $\alpha_s$=0.98 at 1 kHz and of $\alpha_s$=1.05 at 4 kHz. The thickness of the sound absorbing material is 10 cm/5 cm, where the first value refers to the total thickness including the pyramids, and the second value refers to the thickness without the pyramids. Further sound absorbing material 260 such as bitumen foil is placed in between the double MDF plates forming the side walls 210.

Furthermore, a ring 250 of sound absorbing material (also melamine foam) is provided around the outer circumference of the membrane of the speaker 220 and protruding in the direction of the interface. The ring protrudes 10 cm from the wall 211 and has a thickness of 1 cm.

The acoustic chamber 210 according to the second embodiment has a total harmonic distortion (THD) at the coupling site of the interface at 1 kHz below 0.6% and and 100 Hz, 4 kHz and 10 kHz below 0.4%, when including all harmonics of 100 Hz, 1 kHz, 4 kHz or 10 kHz in the range of 40 Hz to 20 kHz, i.e., for 100 Hz the harmonics 200 Hz, 300 Hz, 400 Hz, . . . , 19.8 kHz, 19.9 kHz, 20 kHz; for 1 kHz the harmonics 2 kHz, 3 kHz, 4 kHz, . . . , 19 kHz, 20 kHz; for 4 kHz the harmonics 8 kHz, 12 kHz, 16 kHz and 20 kHz; and for 10 kHz the harmonic at 20 kHz. Moreover, THD for 100 Hz and 10 kHz is less than 0.4% in each case, and the THD is below 0.8% for any frequency in the to range of 20 Hz to 10 kHz, i.e., for the whole frequency range.

Figure 3:
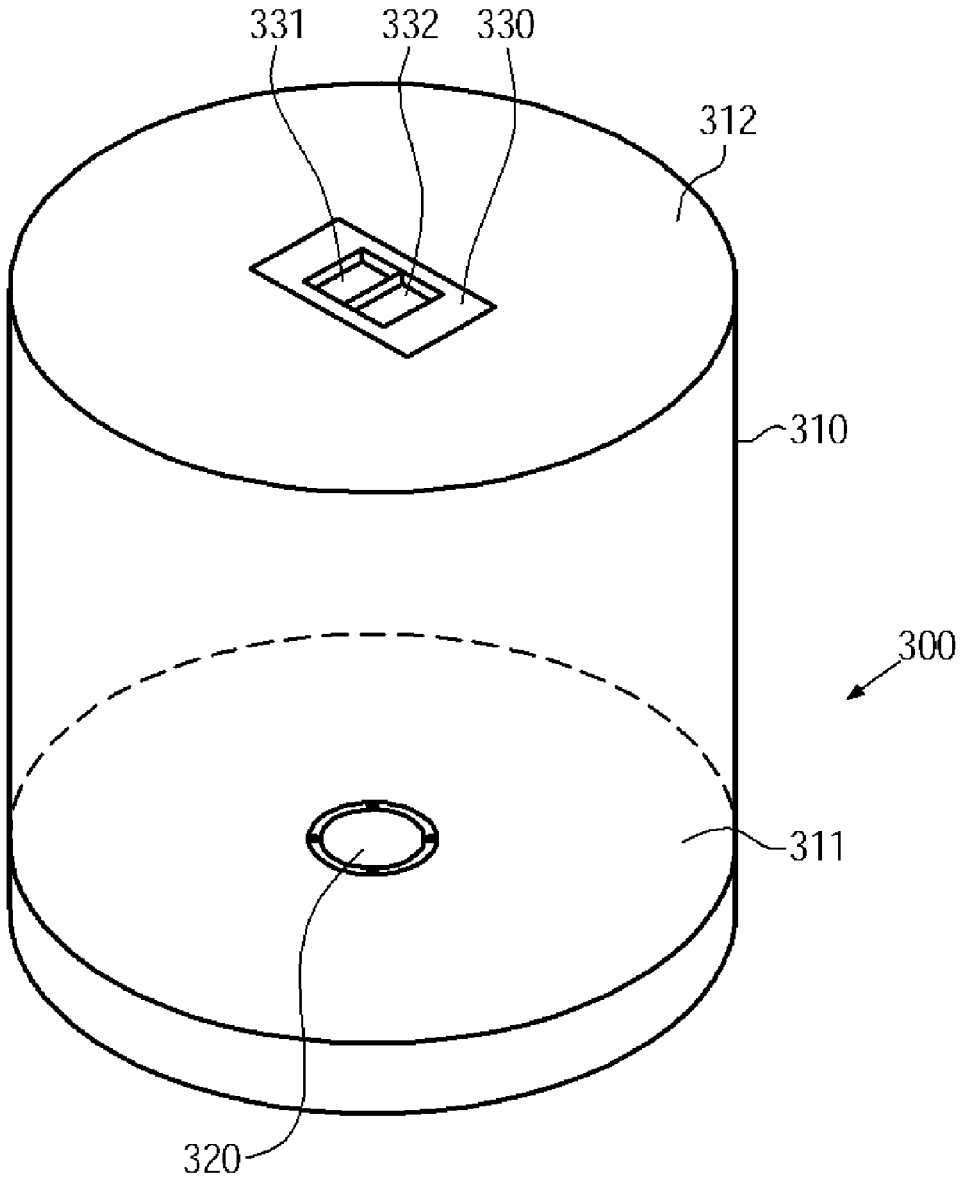
FIG. 3 illustrates a third embodiment of the invention.

FIG. 3 shows a third embodiment of the inventive microelectromechanical system testing device 300, wherein features corresponding to features in the first and second embodiments have the same reference sign in the last two digits and differ only in the hundreds that is increased from 1 to 3 and 2 to 3, respectively.

In this third embodiment the microelectromechanical system testing device 300 comprises an acoustic chamber 310 in the form of a cylinder with circular or oval/elliptical cross section having two opposing walls 311, 312 and a driver 320 for generating sound within the acoustic chamber at a first frequency in the range of 20 Hz to 10 kHz. In this case the frequency generated by the driver is 100 Hz, 1 kHz, 4 kHz and/or 10 kHz, for example. The sound source 320 is arranged at one of the opposing walls, namely the bottom wall 311. The microelectromechanical system testing device 300 comprises an interface 330 with two coupling sites 331, 332.

We claim:

1. Microelectromechanical system testing device, comprising:

an acoustic chamber having two opposing walls;

a sound source for generating sound within the acoustic chamber at a first frequency in the range of 20 Hz to 10 kHz, the sound source being arranged at one of the opposing walls; and an interface for coupling one or more microelectromechanical systems thereto, the interface being arranged at the other of the two opposing walls and comprising a respective coupling site for each microelectromechanical system;

wherein the acoustic chamber is adapted to have a total harmonic distortion (THD) at each coupling site of the interface for the first frequency below 1%, when including all harmonics of the first frequency in the range of 20 Hz to 20 kHz;

wherein a plurality of microelectromechanical systems is coupleable to the coupling sites of the interface, wherein the microelectromechanical system testing device is adapted to have a difference in sound pressure at any one of the interface coupling sites and at a reference point at the interface, in particular the center of the interface, of less than 0.2 dB, and wherein the microelectromechanical system testing device is adapted to have a difference between the total harmonic distortion at any one of the interface coupling sites and at the reference point below 5% of the total harmonic distortion at the reference point.

2. Microelectromechanical system testing device, comprising:

an acoustic chamber having two opposing walls;

a sound source for generating sound within the acoustic chamber at a first frequency in the range of 20 Hz to 10 kHz, the sound source being arranged at one of the opposing walls; and an interface for coupling one or more microelectromechanical systems thereto, the interface being arranged at the other of the two opposing walls and comprising a respective coupling site for each microelectromechanical system;

wherein the acoustic chamber is adapted to have a total harmonic distortion (THD) at each coupling site of the interface for the first frequency below 1%, when including all harmonics of the first frequency in the range of 20 Hz to 20 kHz;

wherein a plurality of microelectromechanical systems is coupleable to the coupling sites of the interface, and wherein the microelectromechanical system testing device is adapted to have a difference in sound pressure at any one of the interface coupling sites and at a reference point at the interface, in particular the center of the interface, of less than 0.2 dB.

3. Microelectromechanical system testing device according to claim 2, wherein the distance between the sound source and the interface is larger than two times the largest dimension of the sound source, in particular larger than two times the diameter of a sound generating membrane of a loudspeaker as the sound source.

4. Microelectromechanical system testing device according to claim 2, wherein the acoustic chamber is a rectangular box, and wherein the distance H between the sound source and the interface is in the range of H=48 cm±12 cm.

5. Microelectromechanical system testing device according to claim 4, wherein the length L of the box is in the range of L=69 cm±21 cm and wherein the width W of the box is in the range of W=58 cm±21 cm.

6. Microelectromechanical system testing device according to claim 2, wherein inside walls of the acoustic chamber with the exception of the wall with the interface are covered with sound absorbing material.

7. Microelectromechanical system testing device according to claim 6, wherein the thickness of the sound absorbing material is in the range of 5 cm to 15 cm.

8. Microelectromechanical system testing device according to claim 6, wherein the sound absorbing material is porous melamine.

9. Microelectromechanical system testing device according to claim 6, wherein the surface of the sound absorbing material has a pyramidal structure.

10. Microelectromechanical system testing device according to claim 2, wherein a ring of sound absorbing material is arranged around the sound source and protrudes from the sound source in the direction of the interface.

11. Microelectromechanical system testing device according to claim 10, wherein the ring protrudes from the sound source by a distance in the range of 1 cm to 20 cm.

12. Microelectromechanical system testing device according to claim 10, wherein the thickness of the ring is in the range of 1 cm to 5 cm.

13. Microelectromechanical system testing apparatus, comprising:

a microelectromechanical system testing device according to claim 2;

a feeding device for feeding microelectromechanical systems to each coupling site of the interface;

wherein the feeding device is preferably a gravitational, a pick-and-place, or a test-in-strip feeding device.

14. Microelectromechanical system testing device according to claim 10, wherein the ring protrudes from the sound source by a distance in the range of 1 cm to 5 cm.

15. Microelectromechanical system testing device according to claim 2, wherein the acoustic chamber is adapted to simultaneously have a total harmonic distortion (THD) at each coupling site of the interface for the first frequency and for a second frequency, for the first frequency being 1 kHz and the second frequency being 4 kHz, below 1%.

16. Microelectromechanical system testing device, comprising:

an acoustic chamber having two opposing walls;

a sound source for generating sound within the acoustic chamber at a first frequency in the range of 20 Hz to 10 kHz, the sound source being arranged at one of the opposing walls; and an interface for coupling one or more microelectromechanical systems thereto, the interface being arranged at the other of the two opposing walls and comprising a respective coupling site for each microelectromechanical system;

wherein the acoustic chamber is adapted to have a total harmonic distortion (THD) at each coupling site of the interface for the first frequency below 1%, when including all harmonics of the first frequency in the range of 20 Hz to 20 kHz;

wherein a plurality of microelectromechanical systems is coupleable to the coupling sites of the interface, and wherein the microelectromechanical system testing device is adapted to have a difference between the total harmonic distortion at any one of the interface coupling sites and at a reference point at the interface, in particular the center of the interface, below 5% of the total harmonic distortion at the reference point.

17. Microelectromechanical system testing device according to claim 16, wherein the acoustic chamber is adapted to simultaneously have a total harmonic distortion (THD) at each coupling site of the interface for the first frequency and for a second frequency, for the first frequency being 1 kHz and the second frequency being 4 kHz, below 1%.

18. Microelectromechanical system testing device according to claim 16, wherein the acoustic chamber is adapted to have a total harmonic distortion (THD) at each coupling site of the interface for any first frequency in the range of 20 Hz to 10 kHz, below 1%.

19. Microelectromechanical system testing device according to claim 16, wherein the acoustic chamber is adapted to have a total harmonic distortion (THD) at each coupling site of the interface for the first frequency below 0.4%.

20. Microelectromechanical system testing device according to claim 16, wherein the microelectromechanical system testing device is adapted to have a difference between the total harmonic distortion at any one of the interface coupling sites and at a reference point at the interface, in particular the center of the interface, below 5% of the total harmonic distortion at the reference point.

* * * * *